US008114258B2

(12) United States Patent
Huber et al.

(10) Patent No.: US 8,114,258 B2
(45) Date of Patent: Feb. 14, 2012

(54) ELECTROLYSIS DEVICE FOR THE PRODUCTION OF ALKALI METAL

(75) Inventors: Guenther Huber, Ludwigshafen (DE); Michael Lutz, Speyer (DE); Michael Wille, Mannheim (DE); Holger Friedrich, Bobenheim-Roxheim (DE); Josef Guth, Freinsheim (DE); Uwe Behling, Waldsee (DE); Axel Franke, Kirchheim (DE); Elisabeth Gunkel, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 1325 days.

(21) Appl. No.: 11/575,187

(22) PCT Filed: Sep. 13, 2005

(86) PCT No.: PCT/EP2005/009820

§ 371 (c)(1),
(2), (4) Date: Mar. 13, 2007

(87) PCT Pub. No.: WO2006/029807

PCT Pub. Date: Mar. 23, 2006

(65) Prior Publication Data

US 2008/0053837 A1 Mar. 6, 2008

(30) Foreign Application Priority Data

Sep. 14, 2004 (DE) ..... 10 2004 044 404

(51) Int. Cl.
*C25D 17/00* (2006.01)
*C25B 9/14* (2006.01)

(52) U.S. Cl. ..... 204/251; 204/194; 204/242; 204/219; 204/245

(58) Field of Classification Search ..... 204/251, 204/194, 242, 245, 219
See application file for complete search history.

(56) References Cited

U.S. PATENT DOCUMENTS 4,089,770 A * 5/1978 Lemke ..... 204/247
6,409,908 B1 6/2002 Huber et al.

FOREIGN PATENT DOCUMENTS

| | | |
|---|---|---|
| DE | 28 30 490 | 1/1979 |
| EP | 1 114 883 A1 | 7/2001 |
| GB | 1155927 | 6/1969 |
| GB | 1 596 097 | 8/1981 |

* cited by examiner

*Primary Examiner* — Harry D Wilkins, III
*Assistant Examiner* — Zulmariam Mendez
(74) *Attorney, Agent, or Firm* — Oblon, Spivak, McClelland, Maier & Neustadt, L.L.P.

(57) ABSTRACT

An electrolysis device producing alkali metals from a liquid alkali metal heavy metal alloy, including at least two connected tubes forming an electrolysis unit. Two solid electrolyte tubes are arranged concentrically in each tube and oriented with openings towards one end of each tube such that a first annular gap for guiding a liquid alkali metal forming an anode is located between the inside of the tube and the outside of the solid electrolyte tubes. An alloy inlet and outlet for the liquid alkali metal in each of the tubes leads into the first annular gap of a tube. An inner chamber sealed off from the alloy inlet, first annular gap, and alloy outlet in each solid electrolyte tube receives liquid alkali metal that can be used as a cathode connected to the alkali metal outlet. Two respective closure devices are arranged at the two ends of each tube.

14 Claims, 5 Drawing Sheets

ELECTROLYSIS DEVICE FOR THE PRODUCTION OF ALKALI METAL

Figure 1:
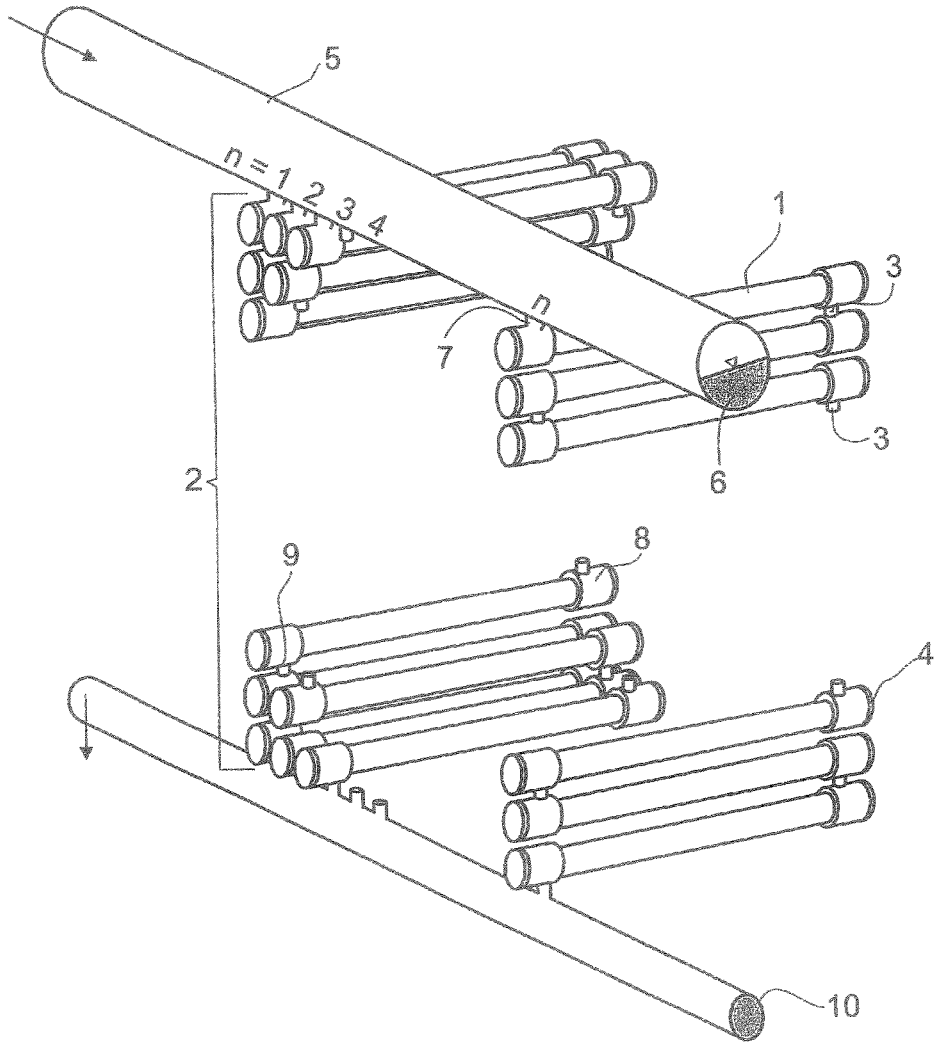

The present invention relates to an electrolysis apparatus for preparing alkali metal from a liquid alkali metal-heavy metal alloy.

For the purposes of the present invention, an alkali metal is, in particular, sodium, potassium or lithium.

Sodium is an important basic inorganic product which is used, inter alia, for preparing sodium compounds such as sodium peroxide, sodium hydride, sodium boranate and sodium amide, for obtaining titanium by a metallothermic process and for reductive purposes in the organic chemical industry, for purifying hydrocarbons and waste oil, for condensations, for the preparation of alkoxides, as polymerization catalyst and in preparative organic chemistry. Sodium is nowadays usually prepared by melt electrolysis of a ternary mixture of NaCl, $CaCl_2$ and $BaCl_2$ in the Downs process.

Lithium is used, inter alia, in nuclear technology for the preparation of tritium, as alloying addition to aluminum, lead or magnesium, in organic syntheses, for the synthesis of complexing metal hydrides, for preparing organometallic compounds, for condensations, dehydrohalogenations, for preparing ternary amines or quaternary ammonium salts, in the mineral oil industry as catalyst and for desulfurization, for the polymerization of isoprene to cis-polymers, in the ceramics industry for regulating the coefficient of expansion, lowering the melting point and the like, for producing lubricants, as antioxidant and purification agent in the metallurgy of iron, nickel, copper and alloys thereof. Lithium is, in the prior art, likewise prepared on an industrial scale by electrolysis of anhydrous alkali metal chloride melts in the Downs process, with the melting points of the salt melts being reduced by addition of alkali metal chlorides.

In the case of the two metals sodium and lithium the operating life of known electrolysis cells is restricted to 2-3 years. Interruption of the power supply or shutdown of the cell generally leads to destruction of the cell. The sodium obtained by the Downs process has, due to the additives to the melt, the disadvantage that it is contaminated primarily with calcium. Although the residual calcium content can be reduced by subsequent purification steps, it can never be removed completely. In the case of the lithium obtained by the Downs process, a significant disadvantage is that the aqueous lithium chloride solutions obtained in the chemical reaction of lithium firstly have to be worked up to produce anhydrous lithium chloride before use in the electrolysis.

Potassium is likewise an important basic inorganic product which is used, for example, for the preparation of potassium alkoxides, potassium amides and potassium alloys. It is nowadays prepared industrially primarily by reduction of potassium chloride by sodium in a reactive distillation. A disadvantage is that the process operates at high temperatures. A addition, the potassium formed contains about 1% of sodium as impurity and therefore has to be purified by a further rectification. The great disadvantage is that the sodium used is expensive. This is because sodium is obtained industrially by electrolysis of molten sodium chloride in the Downs process, which requires a high energy input.

Alkali metal amalgams are obtained in large quantities as intermediate in chloralkali electrolysis by the amalgam method and generally reacted with water to for alkali metal hydroxide solutions and then recirculated in the closed circuit to the chloralkali electrolysis.

GB 1,155,927 describes a process in which sodium metal can be obtained by electrochemical means using a solid sodium ion conductor with amalgam as anode and sodium as cathode. However, repetition of the method described in GB 1,155,927 does not lead to the results described there in respect of sodium conversion, product purity and current density. Furthermore, the system described becomes unstable over the course of a few days when the claimed temperature range is adhered to.

EP 1 114 883 A1 describes the preparation of an alkali metal from alkali metal amalgam in a process which is improved compared to the process described in GB 1,155,927. In this process, the preparation is carried out by electrolysis using an anode comprising alkali metal amalgam, a solid electrolyte which conducts alkali metal ions and liquid alkali metal as cathode, with the alkali metal amalgam used as anode being kept in motion. The electrolysis is carried out in an electrolysis cell comprising a tubular solid electrolyte which is closed at one end and is installed in a concentric stainless steel tube so as to form an annular gap. This process carried out in this electrolysis cell has the following advantages over the above-described prior art, in particular over the preparation of alkali metals by the Downs process:

- The cell allows a process having a 40% lower energy consumption including the preliminary stage due to the higher current yield resulting from the reduced backreaction ad the low cell voltage.
- The cell has no limitations to its life resulting from the process.
- Part load operation or interruption of production are possible.
- Only liquid materials which are easy to meter are used and produced.
- The salts are used as aqueous solutions in the preliminary stage of the process described.
- The apparatus operates fully automatically.
- Highly pure alkali metals are produced.
- No addition purification steps are necessary.

It was object of the present invention to provide a electrolysis apparatus which is based on the process described in EP 1 114 883 A1 and the apparatus disclosed therein and makes it possible to prepare alkali metals or industrial scale.

This object is achieved according to the invention by an electrolysis apparatus for preparing alkali metal from a liquid alkali metal-heavy metal alloy, which comprises

- at least two tubes which are arranged essentially horizontally above one another and are connected to one another by a connecting piece and form an electrolysis unit,
- two solid electrolyte tubes arranged in each of the tubes, which conduct alkali metal ions and are closed at one end and have a opening at the other end, with the solid electrolyte tubes being arranged concentrically in the tube and in each case having the opening facing one end of the tube so that a first annular gap for conducting the liquid alkali metal-heavy metal alloy which forms one anode is present between the inside of the tube and the outside of the solid electrolyte tubes,
- an alloy inlet and an alloy outlet for the liquid alkali metal-heavy metal alloy in each of the tubes which open at a horizontal distance from one another from the top or from the bottom, respectively, into the first annular gap of one tube,
- an interior space in each of the solid electrolyte tubes for accommodating the liquid alkali metal which can be employed as cathode, which space is sealed from the alloy inlet, the first annular gap and the alloy outlet and is connected to an alkali metal outlet and
- in each case two closure devices which are located at the two ends of each tube.

The electrolysis apparatus of the invention has the advantage that it has a modular construction. At least two tubes arranged above one another are connected to an electrolysis unit through which a volume stream of alkali metal-heavy metal alloy flows from the first tube to the last tube. The number of tubes can be increased at will. Likewise, the number of electrolysis units used in parallel can be increased at will. The electrolysis apparatus of the invention is intended for continuous operation. The flow of the liquid alkali metal-heavy metal alloy is preferably driven by a pump located outside the electrolysis apparatus. The essentially horizontal tubes together with the solid electrolyte tubes pushed into them form the reaction module in which the electrolysis takes place. The construction according to the invention of the electrolysis apparatus ensures that the alkali metal-heavy metal alloy is conveyed so that transport of the alkali metal dissolved in the heavy metal to the surface of the solid electrolyte which conducts alkali metal ions is ensured for the high current densities of industrial production.

Furthermore, appropriate selection of materials for the construction of the electrolysis apparatus of the invention makes it possible to achieve a long operating life as is customary for apparatuses in industrial chemistry. The electrolysis in the apparatus of the invention can be interrupted at any time without damaging the apparatus.

Liquid alkali metal-heavy metal alloy, in particular a alkali metal amalgam containing sodium potassium or lithium as alkali metal, is fed into the apparatus of the invention. Further possible heavy metals as constituent of the liquid alkali metal-heavy metal alloy are gallium or lead or alloys of gallium, lead and mercury.

To keep sodium amalgam in liquid form, the sodium concentration of this solution has to be less than 1% by weight, preferably from 0.2 to 0.5% by weight. To keep potassium amalgam in liquid form, the potassium concentration of this solution is less than 1.5% by weight, preferably 0.3 to 0.6% by weight. To keep lithium amalgam in liquid form, the lithium concentration of this solution is less than 0.19% by weight, preferably from 0.02 to 0.06% by weight.

The material selected for the essentially horizontal tubes which are connected to one another is preferably stainless steel or graphite. As materials for the solid electrolyte tubes, ceramic materials used in sodium production, e.g. Nasicon® whose composition is given in EP-A 0 553 400, are possible. Glasses which conduct sodium ions also zeolites and feldspars are also suitable. In the preparation of potassium, a large number of materials can likewise be used. Both the use of ceramics and the use of glasses are possible. For example, the following materials are suitable: $KBiO_3$, gallium oxide-titanium dioxide-potassium oxide systems, aluminum oxide-titanium dioxide-potassium oxide systems and Kasicon® glasses. However, preference is given to sodium-β"-aluminum oxide, sodium-β-aluminum oxide and sodium-β/β"-aluminum oxide or potassium-β"-aluminum oxide, potassium-β-aluminum oxide and potassiumβ/β"-aluminum oxide. Potassium-β"-aluminum oxide, potassium-β-aluminum oxide and potassium-β/β"-aluminum oxide can be prepared from sodium-β/β"-aluminum oxide, sodium-β-aluminum oxide and sodium-β/β"-aluminum oxide, respectively, by cation exchange. In the preparation of lithium, a large number of materials can likewise be used. For example, the following materials are possible: $Li_{4-x}Si_{1-x}P_xO_4$, Li-beta"-$Al_2O_3$, Li-beta-$Al_2O_3$, lithium analogues of Nasicon® ceramics, lithium ion conductors having a perovsite structure and sulfidic glasses as lithium ion conductors.

The solid electrolyte tubes are closed at one end and are preferably thin-walled but pressure-resistant and designed with a circular cross section.

The tubes which are arranged above one another and are connected to one another have a length of from 0.5 m to 2 m, preferably from 0.9 m to 1.1 m. The internal diameter of the tubes is from 35 mm to 130 mm, preferably from 65 mm to 75 mm. The tube thickness (wall thickness) is from 1 mm to 30 mm, preferably from 2.5 mm to 3.6 mm, when commercial welded tubes are used and preferably from 15 to 20 mm when the tube has been produced by casting.

The solid electrolyte tubes have a external diameter of from 30 mm to 100 mm, preferably from 55 mm to 65 mm. The wall thickness of the solid electrolyte tubes is from 0.9 mm to 2.5 mm, preferably from 1.2 mm to 1.8 mm. They have a length of from 20 cm to 75 cm, preferably from 45 cm to 55 cm.

This gives a gap width of the first annular gap of from 2.5 mm to 15 mm, preferably from 4.5 mm to 5.5 mm.

The alkali metal-heavy metal alloy enters the first annular gap surrounding the solid electrolyte tubes via the alloy inlet. The electrolysis is operated by applying an electric potential between the outside of the solid electrolyte tubes which comprise a solid electrolyte which conducts alkali metal ions and are closed at one end and the inside, so that the alkali metal-heavy metal alloy flowing outside in a longitudinal direction in the first annular gap forms the positive pole and the alkali metal formed inside forms the negative pole. The potential difference produces a electric current which leads to alkali metal being oxidized at the interface between alkali metal-heavy metal alloy and ion conductor, the alkali metal ion then being transported through the ion conductor and then being reduced back to metal at the interface between ion conductor and alkali metal in the interior of the solid electrolyte tubes. During the electrolysis, the alkali metal-heavy metal alloy stream is thus continuously depleted in alkali metal in proportion to the electric current which flows. The alkali metal transferred in this way to the inside of the solid electrolyte tubes can be discharged continuously from there via the alkali metal outlet. The electrolysis is carried out at a temperature in the range from 260 to 400° C. In the case of the electrolysis of an alkali metal amalgam, the temperature should be below the boiling point of mercury, preferably at from 310° C. to 325° C. when the alkali metal is sodium and at from 265° C. to 280° C. when the alkali metal is potassium and at from 300° C. to 320° C. when the alkali metal is lithium.

The alkali metal-heavy metal alloy is preferably preheated to from 200° C. to 320° C., preferably from 250° C. to 280° C., before being fed to the electrolysis apparatus of the invention. For this purpose, the electrolysis apparatus can be provided with a heat exchanger, in particular a countercurrent heat exchanger, so that the hot alkali metal-heavy metal alloy depleted in alkali metal which leaves the last tube of the electrolysis apparatus heats the alloy feed to the first tube. However, it is also possible to preheat the alkali metal-heavy metal alloy by means of heating wires wound around the feed line.

At the two end faces of the essentially horizontal tubes there is in each case a closure device which is suitable for in each case accommodating a solid electrolyte tube which is closed at one end and comprises a solid electrolyte which conducts alkali metal ions. The opening of the solid electrolyte tubes is directed outward. The closure device is configured in terms of the seals so that the space filled with alkali metal-heavy metal alloy in the essentially horizontal tubes is sealed off in a leakage-free manner both from the environment and from the interior of the solid electrolyte tubes.

Furthermore, the closure device also seals the interior space of the solid electrolyte tubes against the environment. The closure device is preferably connected at least partially releasably to the tube, so that the solid electrolyte tubes can be replaced without problems in the case of repairs.

The electrolysis apparatus of the invention preferably has from 2 to 100 tubes, particularly preferably from 5 to 25 tubes, per electrolysis unit. It comprises n parallel electrolysis units, where n is preferably from 1 to 10, particularly preferably from 5 to 20.

In a preferred embodiment of the present invention, the electrolysis apparatus has an alloy distributor for supplying at least one electrolysis unit with the alkali metal-heavy metal alloy, with the alloy distributor being connected via a outlet piece to a electrolysis unit. The alkali metal-heavy metal alloy level in the alloy distributor is preferably kept constant. The alloy distributor is, for example, continually half-filled with liquid alkali metal-heavy metal alloy. At the bottom of the liquid distributor there are n outlet pieces which each open into an electrolysis unit configured as tube system connected downstream. The alkali metal-heavy metal alloy stream flowing into the alloy distributor is consequently divided up into n parallel individual streams.

In a preferred embodiment of the present invention, the alloy inlet and the alloy outlet on the tubes are arranged so that the alkali metal-heavy metal alloy is conducted as a meandering stream through the electrolysis unit. In this case, the alkali metal-heavy metal alloy flows through a electrolysis unit comprising a tube system made up of essentially horizontal tubes, flowing from one tube via its alloy outlet located at one side into the next lower tube via its alloy inlet located on the same side, then flowing horizontally through this and leaving it again in a downward direction via the alloy outlet located on the other side and flowing into the next essentially horizontal tube.

In a preferred embodiment of the present invention, the electrolysis apparatus has an alloy collector for taking up the alkali metal-heavy alloy which has flowed through the electrolysis unit, with the alloy collector being able to be connected to the alloy distributor for at least partial recirculation of the alkali metal-heavy metal alloy. The recirculated alkali metal-heavy metal alloy which has been depleted in alkali metal is mixed in the alloy distributor with alkali metal-heavy metal alloy which is enriched in alkali metal.

In another embodiment of the present invention, the alloy distributor is continually supplied exclusively with enriched alkali metal-heavy metal alloy and the alkali metal-heavy metal alloy which has been depleted in the electrolysis unit is collected in the alloy collector and not recirculated.

The alkali metal formed in the interior of the solid electrolyte tubes is, according to the invention, discharged via the alkali metal outlet. The alkali metal outlet is preferably connected via a discharge line to an alkali metal collector into which the discharge line opens from the top. The alkali metal collector preferably has the form of a collecting channel with a lid. The introduction of the alkali metal into the alkali metal collector from the top also has the advantage that the alkali metal cannot flow back from the alkali metal collector via the discharge line into the electrolysis unit, for example in the case of a broken solid electrolyte tube. Flow back into the electrolysis unit could result in the destruction of the entire electrolysis unit, since the backflowing alkali metal would come into contact with alkali metal-heavy metal alloy and a exothermic backreaction will occur.

From alkali metal collector the liquid alkali metal flows via heated pipes into storage tanks. In a preferred embodiment of the present invention, the alkali metal collector is located at a higher level than the alloy distributor and/or the alkali metal collector contains an inert gas at a pressure above ambient pressure. This has the advantage that, for example in the case of a broken solid electrolyte tube, no alkali metal-heavy metal alloy can get into the alkali metal present in the alkali metal collector. The inert gas is preferably at a gauge pressure of from 0.2 bar to 10 bar, particularly preferably 1 bar. The alkali metal is transported into the alkali metal collector by the pressure of the alkali metal newly formed in the interior of the solid electrolyte tubes against the inert gas pressure and/or against the forces produced by the height difference between the alkali metal source and the alkali metal collector.

In a preferred embodiment of the present invention, each tube and each solid electrolyte tube has a separate electric connection. As a result of this, when one electric connection is interrupted, the electrolysis apparatus is not completely shutdown but only one tube or one solid electrolyte tube is locally shutdown.

Each of the closure devices in the electrolysis apparatus of the invention preferably has a alkali metal outlet and an electric connection for the cathode. Electric power to the cathode can be supplied, for example, via the alkali metal outlet configured as electrically conductive discharge tube.

The electric connection for the cathode of a multiplicity of solid electrolyte tubes present in a electrolysis unit is preferably via a elastic electrically conductive strip in each case which contacts a negative bridge. The negative bridge is an electrically conductive component which is connected to the negative pole of a voltage source. It is in each case connected via an elastic electrically conductive strip to the electric connection of the cathode in the interior of each of the multiplicity of solid electrolyte tubes. The strip is elastic so as to be able to accommodate different thermal expansion properties of the negative bridge and the electric connection. Furthermore, the strip can be configured as a fuse which in the case of an excessively high current is destroyed by the heat produced.

Each electrically conductive strip can also have a individual electric resistance which is designed so that the same voltage is applied to each tube.

The alkali metal collector is electrically insulated from the interior of the respective solid electrolyte tube. This is achieved, for example, by the respective tube lead-through via which the discharge line opens into the upper side of the alkali metal collector being electrically insulated so that there is an electric potential separation between the individual alkali metal sources which are all connected via their discharge line to the alkali metal collector and between the respective alkali metal source and the alkali metal collector. This is only possible because the alkali metal drips from the top into the (e.g. nitrogen-filled) alkali metal collector and does not for a continuous liquid thread. In the case of breakage of a solid electrolyte tube, a short circuit of the discharge lines concerned, inter alia, is avoided.

In a preferred embodiment of the present invention, the electric connection for the anode runs via the tube which is in contact with a positive bridge. The positive bridge is an electrically conductive component which is connected to the positive pole of a voltage source. It can for example, be configured as a flat rod having a plurality of balcony-like projections, with each tube resting on a projection and being supported and provided with an electric connection by this. The positive bridge is in this case preferably a solid steel construction which can assume this double function. However, the positive bride can also be additional aluminum rail which is not load-bearing and is connected via elastic, electrically conductive strips to the tubes.

In preferred embodiment of the electrolysis apparatus of the invention, a displacement body is arranged in the interior of each of the solid electrolyte tubes so that there is a second annular gap for accommodating liquid alkali metal between the outside of the displacement body and the inside of the solid electrolyte tube. The displacement body reduces the volume in the interior of the solid electrolyte tube which can be filled with alkali metal. This has the advantage that at any point in time only a small amount of alkali metal is present in the solid electrolyte tube so that if the solid electrolyte tube fails suddenly, only this small amount can come into contact with the alkali metal-heavy metal alloy surrounding the solid electrolyte tube. The energy potential of the backreaction is thereby kept as small as possible. The displacement body can be a solid metal body. This metal body has the further advantage that it can be used as cathode if the electrolysis is started using a solid electrolyte tube which is not yet filled with alkali metal. However, a closed hollow body can also serve as displacement body. This hollow body has the advantage that, owing to its low weight, it can be more easily pushed into the solid electrolyte tube without damaging the latter. Furthermore, a thin-walled metal tube which is closed at one end and is not precisely fitted to the shape of the interior of the solid electrolyte tube and is introduced into the solid electrolyte tube so that a very narrow second annular gap is formed can also serve as displacement body. A further body can be introduced as reinforcement into the thin-walled metal tube. The displacement body configured a thin-walled metal tube has the advantage that the amount of alkali metal which is mixed with alkali metal-heavy metal alloy in the event of failure of the solid electrolyte tube is very small.

In a preferred embodiment of the present invention, a thermally insulated heating chamber heated by circulating air surrounds the tubes together with the closure devices. The electrolysis apparatus is brought to the temperature necessary for the electrolysis by being installed in the heating chamber which is thermally insulated from the surroundings and is heated by means of circulating air. Heating can occur electrically or by means of oil or gas burners. Heating may be necessary only when starting up the electrolysis or in phases in which the electrolysis is interrupted. Cooling of the electrolysis apparatus of the invention can be effected by introducing air into the heating chamber and taking off hot air.

The invention further provides for the use of the electrolysis apparatus of the invention for preparing sodium, potassium or lithium from a liquid alkali metal amalgam.

DRAWING

The invention is illustrated below with the aid of the drawing.

In the drawing:

FIG. 1 schematically shows a electrolysis apparatus according to the invention having a multiplicity of electrolysis units comprising a multiplicity of tubes.

Figure 2:
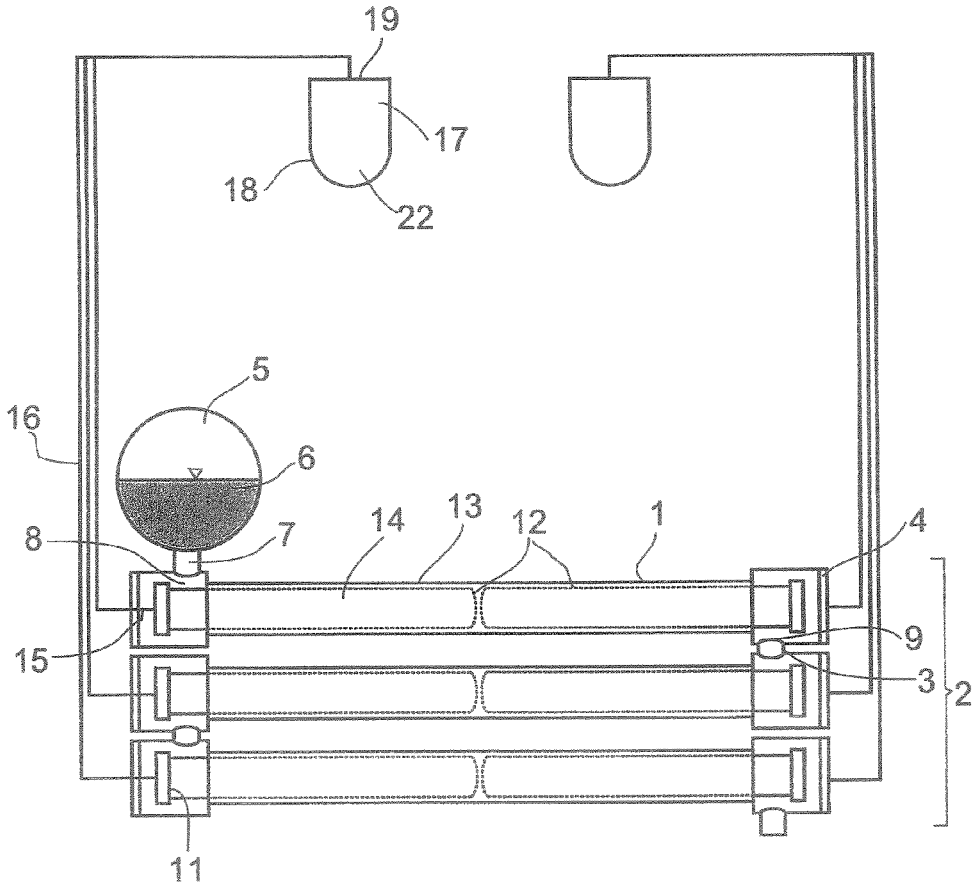
Figure 3:
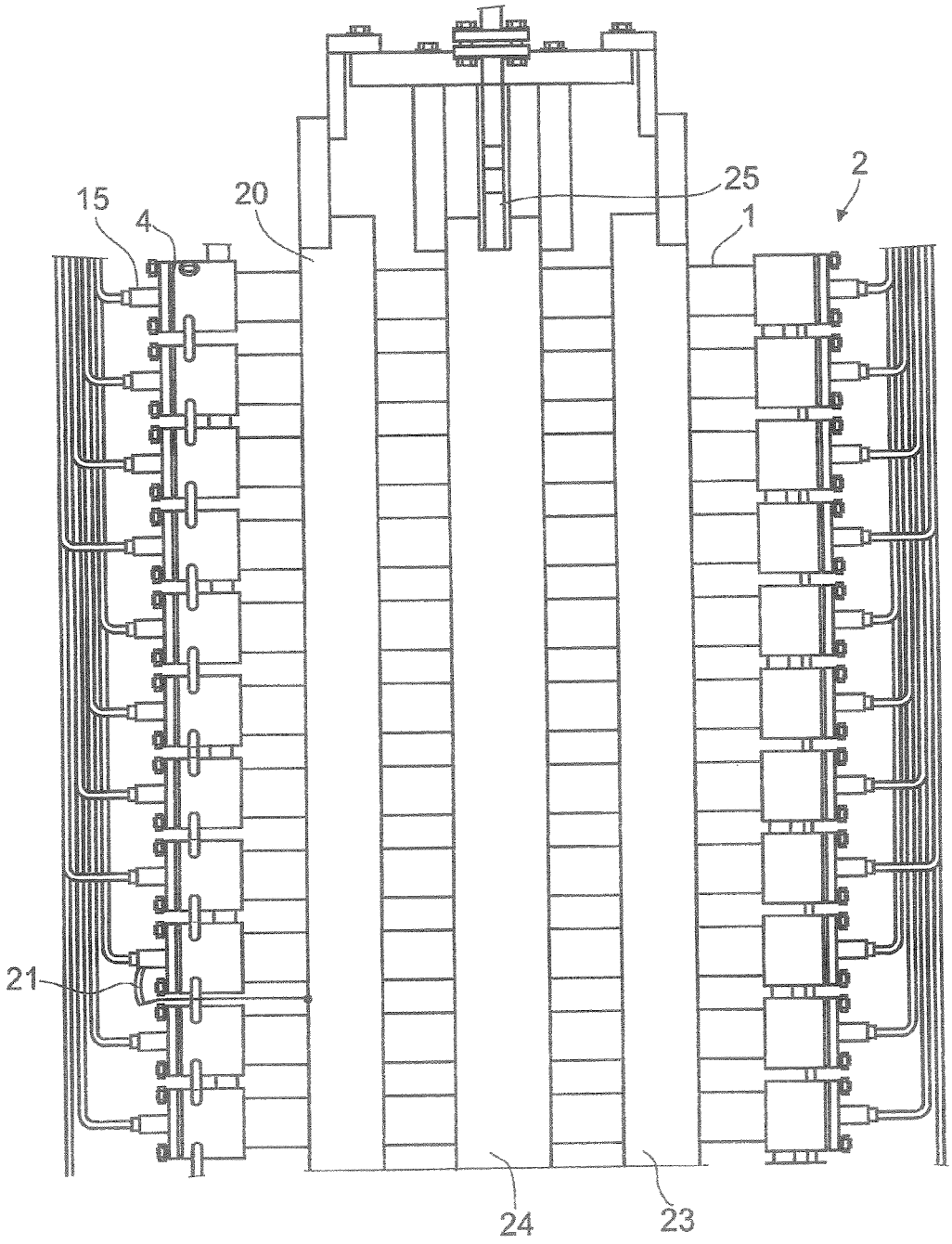
Figure 4:
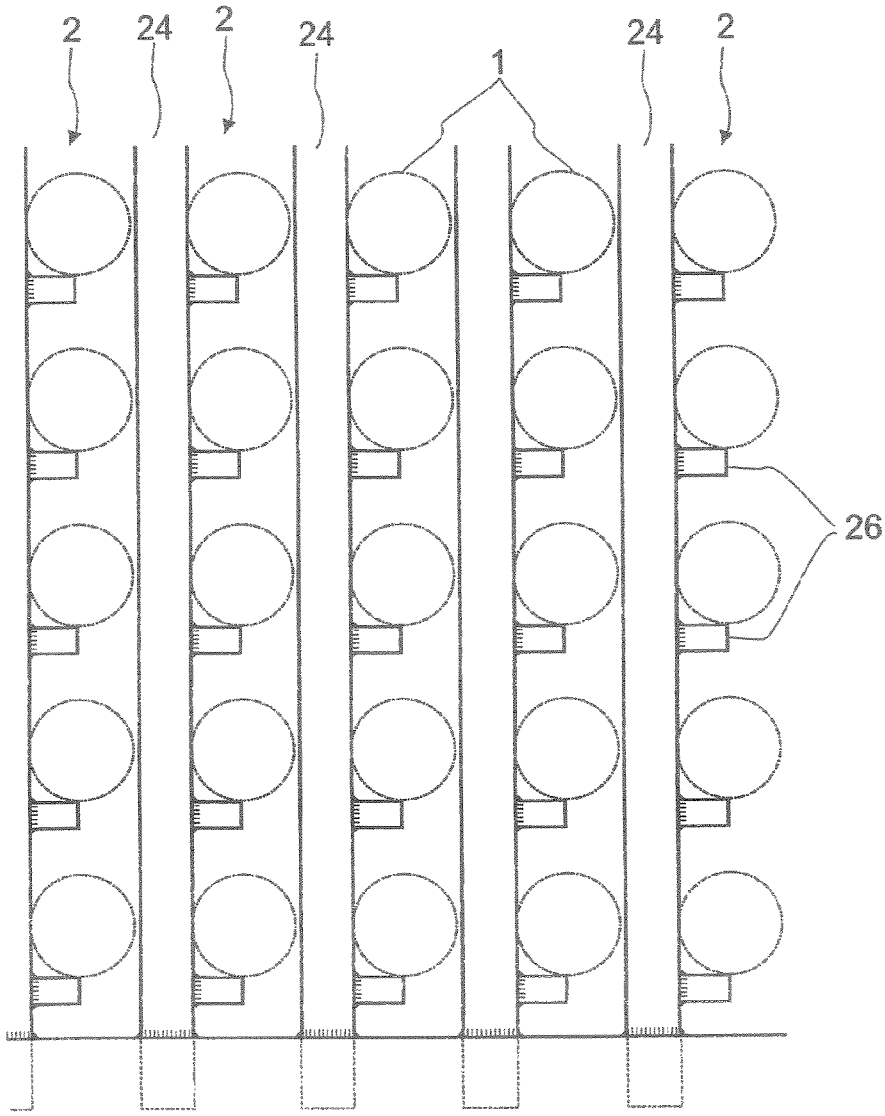
Figure 5:
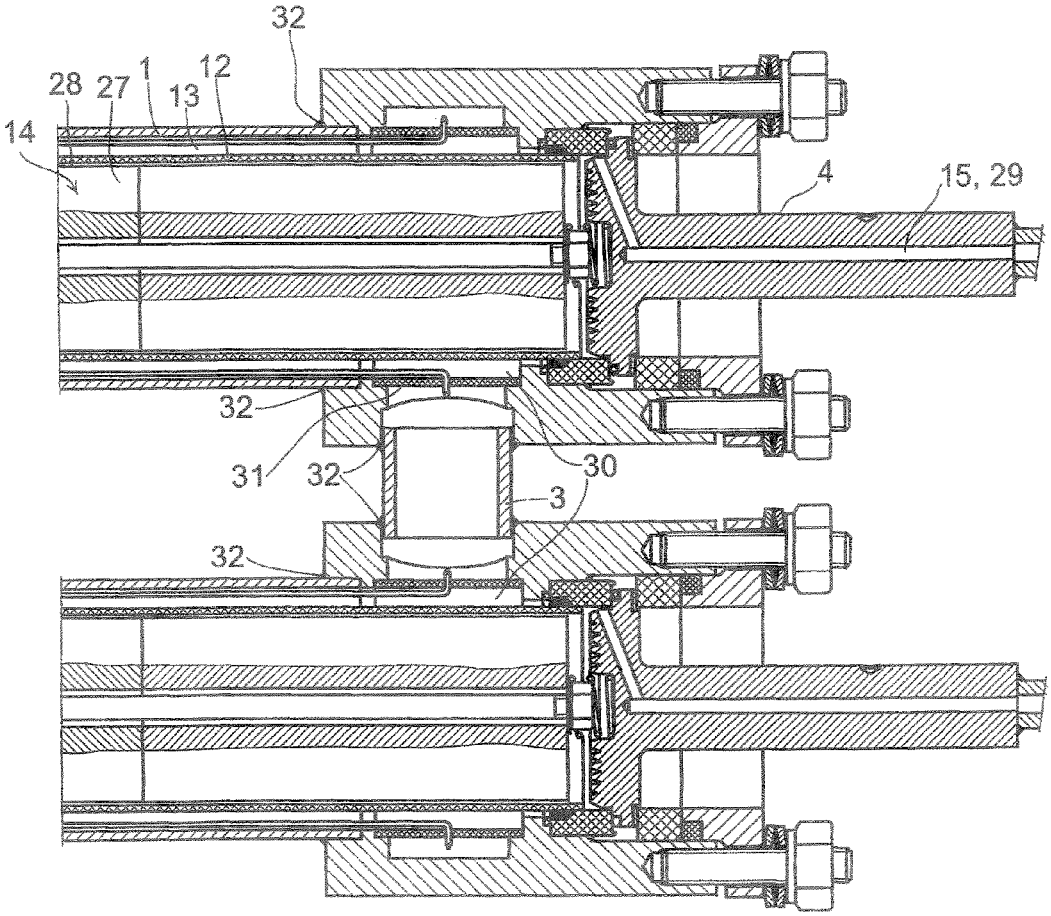

FIG. 2 schematically shows an electrolysis apparatus according to the invention having a alkali metal collector located above the alloy distributor, FIG. 3 shows an embodiment of an electrolysis unit in a electrolysis apparatus according to the invention with its electric connections, FIG. 4 shows an embodiment with positive bridges for a electrolysis apparatus according to the invention and FIG. 5 shows a section of two tubes arranged above one another having displacement bodies in the solid electrolyte tubes.

PARTICULAR EMBODIMENTS

FIG. 1 schematically shows a electrolysis apparatus according to the invention having a multiplicity of electrolysis units.

The electrolysis apparatus comprises a multiplicity of essentially horizontal tubes 1 which are arranged above one another and are connected with one another and form an electrolysis unit 2. The apparatus depicted comprises a multiplicity of electrolysis units 2 which are arranged parallel to one another and are numbered n=1, 2, . . . n. The tubes 1 within an electrolysis unit 2 are connected to one another via connecting pieces 3. The tubes 1 of different electrolysis units 2 have no connection to one another. The ends of each tube 1 are provided with closure devices 4 which are each connected to a connecting piece 3. An alloy distributor 5 is about half filled with liquid alkali metal-heavy metal alloy 6 and supplies the n electrolysis units 2 with the alkali metal-heavy metal alloy 6 via a outlet piece 7. The outlet piece 7 opens into a alloy inlet 8 of a tube 1 which is located in the vicinity of one end of the tube 1. In the tube 1 (in the first annular space which is not shown), the alkali metal-heavy metal alloy 6 flows to near to the other end of the tube 1 where the alloy outlet 9 of this tube 1 is located. The alkali metal-heavy metal alloy 6 travels through the alloy outlet 9, a connecting piece 3 and an alloy inlet 8 of the next lower tube 1 into this next lower tube 1 and once again flows through this in a longitudinal direction. The alkali metal-heavy metal alloy 6 is thus conducted as a meandering stream through the electrolysis unit 2. An alloy collector 10 collects the alkali metal-heavy metal alloy depleted in alkali metal from the last tube 1 of each of the n electrolysis units 2 and allows it to be either recirculated to the electrolysis apparatus or discharged into a storage container. The alkali metal formed in the electrolysis is taken off via an alkali metal outlet (not shown) at each end of the tube 1.

FIG. 2 shows a further schematic depiction of an electrolysis apparatus according to the invention.

The tubes 1 arranged above one another in an electrolysis unit 2 are shown. Two solid electrolyte tubes 12 which are closed at one end and have a opening 11 at the other end are present in each tube 1. The solid electrolyte tubes 12 are arranged concentrically in the tube 1 and have their opening 11 in each case directed toward one end of the tube 1. Between the inside of the tube 1 and the outside of the solid electrolyte tubes 12 there is a first annular gap 13 for conducting the liquid alkali metal-heavy metal alloy 6 which travels from the alloy distributor 5 via the outlet piece 7 and the alloy inlet 8 into the uppermost tube 1 and flows along the annular gap 13 around the solid electrolyte tube 12 to the alloy outlet 9 which opens into a connecting piece 3. Each closure device 4 serves as holder for a solid electrolyte tube 12 which is detachable, so that a defective solid electrolyte tube 12 can be replaced without problems. The interior space 14 of the solid electrolyte tube 12 is sealed off from the parts of the electrolysis unit 2 in which alkali metal-heavy metal alloy is present, in particular from the alloy inlet 8, the first annular gap 13 and the alloy outlet 9 of the tube 1 in which the solid electrolyte tube 12 is located. The interior space 14 serves to accommodate liquid alkali metal which is formed there during the electrolysis and can be utilized as cathode of the electrolysis apparatus. The interior space 14 is connected to a alkali metal outlet 15 which conducts the alkali metal 22 via a discharge line 16 to an alkali metal collector 17 positioned above the alloy distributor 5. The alkali metal collector 17 is preferably filled with a inert gas under super atmospheric pressure. The alkali metal collector 17 is, in the embodiment of the present invention depicted in FIG. 2, configured as a collecting channel 18 with a lid 19, with the discharge line 16 opening from the top through the lid 19 into the alkali metal collector 17. If one of the solid electrolyte tubes 12 should fail, only a small amount of alkali metal from the discharge line 16 and the interior space 14 can react with the alkali metal-heavy metal alloy in the tube 1 as a result of this construction. The alkali metal-heavy metal alloy 6 does not get into the alkali metal collector 17. A failure in the electrolysis apparatus of the invention can therefore be tolerated without the electrolysis having to be interrupted and without consequent damage or a deterioration in the quality of the alkali metal produced occurring. The electrolysis can be continued by means of the undamaged solid electrolyte tubes 12.

FIG. 3 shows a embodiment of an electrolysis unit with its electric connections.

The electrolysis unit 2 is once again formed by a multiplicity of tubes 1. Each tube 1 and each solid electrolyte tube 12 (not shown) has a separate electric connection Each closure device 4 has both a alkali metal outlet 15 ad a electric connection for the cathode. The elect connection for the cathode in all solid electrolyte tubes 12 on the side of the tubes 1 is achieved by means of a first negative bridge 20 which is at a negative electric potential and is in each case connected via a elastic electrically conductive strip 21 to an alkali metal outlet 15 configured as a small metal tube. The electrically conductive strip is depicted for only one tube 1 in FIG. 3, but all other tubes are equipped likewise. A second negative bridge 23 is connected to the cathodes on the other side of the tubes 1.

The electric connection for the anode is via the tube 1 itself which is electrically conductive, by contacting the outside of each of the tubes 1 with a positive bridge 24 which is at a positive electric potential. The part of the closure device 4 which conveys alkali metal is electrically insulated from the part conducting the alkali metal-heavy metal alloy. The positive bridge 24 serves not only for providing electric contact but also for supporting the individual tubes 1 (see FIG. 4) and is fastened by means of a suspension device 25 to a supporting frame.

FIG. 4 shows an embodiment of the present invention having a plurality of positive bridges for a plurality of electrolysis units.

The tubes 1 of the five electrolysis units 2 shown in each case rest on a projection 26 of a positive bridge 24 and are in this way firstly supported and secondly provided with electric contact. The positive bridge 24 with the projections 26 is preferably a solid steel construction.

FIG. 5 shows a section of two tubes arranged above one another.

The first annular gap 13 which surrounds the solid electrolyte tube 12 can be seen inside a tube 1. The interior of the solid electrolyte tube 2 is filled virtually completely by a displacement body 27 so that only a second annular gap 28 between the outside of the displacement body 27 and the inside of the solid electrolyte tube 12 remains free for the alkali metal formed. The alkali metal is pushed by the newly formed alkali metal into a drilled hole 29 in the closure device 4 which serves as alkali metal outlet 15. The alkali metal-heavy metal alloy 6 flows through the first annular gap 13 of the upper tube via a screen 31 and an annular space 30 into the connecting piece 3 and from there into the lower tube. This geometric configuration in which the connecting pieces 3 open into an annular space 30 which is separated from the first annular gap 13 by a circumferential screen 31 is advantageous for distributing the alkali metal-heavy metal alloy stream over the cross section of the first annular gap 13 serving as reaction zone Furthermore, this arrangement prevents interfering solid particles from getting into the reaction zone and leading to blockages there. The electrolysis unit shown in section in FIG. 5 is produced by welding turned parts at the welds 32 shown. However, production of these parts in a single piece by metal casting is also possible.

LIST OF REFERENCE NUMERALS

1 Tube
2 Electrolysis unit
3 Connecting piece
4 Closure device
5 Alloy distributor
6 Alkali metal-heavy metal alloy
7 Outlet piece
8 Alloy inlet
9 Alloy outlet
10 Alloy collector
11 Opening
12 Solid electrolyte tube
13 First annular gap
14 Interior space
15 Alkali metal outlet
16 Discharge line
17 Alkali metal collector
18 Collecting channel
19 Lid
20 First negative bridge
21 Strip
22 Alkali metal
23 Second negative bridge
24 Positive bridge
25 Suspension device
26 Projection
27 Displacement body
28 Second annular gap
29 Drilled hole
30 Annular space
31 Screen
32 Welds

The invention claimed is:

1. An electrolysis apparatus for preparing alkali metal from a liquid alkali metal-heavy metal alloy, comprising:

at least two tubes which are arranged essentially horizontally above one another and are connected to one another by a connecting piece and form an electrolysis unit;

two solid electrolyte tubes arranged in each of the tubes, which conduct alkali metal ions and are closed at one end and have an opening at the other end, with the solid electrolyte tubes being arranged concentrically in the tube and having the opening facing one end of the tube so that a first annular gap for conducting the liquid alkali metal-heavy metal alloy which forms one anode is present between the inside of the tube and the outside of the solid electrolyte tubes;

an alloy inlet and an alloy outlet for the liquid alkali metal-heavy metal alloy in each of the tubes which open at a horizontal distance from one another from the top or from the bottom, respectively, into the first annular gap of one tube;

an interior space in each of the solid electrolyte tubes for accommodating the alkali metal which can be employed as a cathode, which space is sealed from the alloy inlet, the first annular gap, and the alloy outlet and is connected to an alkali metal outlet; and two closure devices which are located at the two ends of each tube.

2. The electrolysis apparatus according to claim 1, comprising from 2 to 100 tubes in the electrolysis unit and n parallel electrolysis units, where n=1 to 100.

3. The electrolysis apparatus according to claim 1, having an alloy distributor for supplying at least one electrolysis unit with the alkali metal-heavy metal alloy, with the alloy distributor being connected via an outlet piece to the electrolysis unit.

4. The electrolysis apparatus according to claim 1, wherein the alloy inlet and the alloy outlet are located on the tubes at such positions that the alkali metal-heavy metal alloy is conducted as a meandering stream through the electrolysis unit.

5. The electrolysis apparatus according to claim 3, having an alloy collector for collecting the alkali metal-heavy metal alloy which has flowed through the electrolysis unit, with the alloy collector being connected to the alloy distributor for at least partial recirculation of the alkali metal-heavy metal alloy.

6. The electrolysis apparatus according to claim 3, wherein the alkali metal outlet is connected via a discharge line to an alkali metal collector into which the discharge line opens from the top, the alkali metal collector being located at a higher level than the alloy distributor.

7. The electrolysis apparatus according to claim 6, wherein the alkali metal collector contains an inert gas at a pressure higher than atmospheric pressure.

8. The electrolysis apparatus according to claim 6, wherein the alkali metal collector is electrically insulated from the interior space of the solid electrolyte tubes.

9. The electrolysis apparatus according to claim 1, wherein each tube and each solid electrolyte tube has a separate electric connection.

10. The electrolysis apparatus according to claim 1, wherein each of the closure devices has an alkali metal outlet and an electric connection for the cathode, the electric connection for the cathode of a multiplicity of solid electrolyte tubes present in an electrolysis unit being via an elastic electrically conductive strip which contacts a negative bridge, each electrically conductive strip having an individual electric resistance which is configured so that the same voltage is applied to each tube.

11. The electrolysis apparatus according to claim 10, wherein an electric connection for the anode runs via the tube which is in contact with a positive bridge.

12. The electrolysis apparatus according to claim 1, wherein a displacement body is arranged in the interior space of each of the solid electrolyte tubes so that there is a second annular gap for accommodating liquid alkali metal between the outside of the displacement body and the inside of the solid electrolyte tube.

13. The electrolysis apparatus according to claim 1, wherein a thermally insulated heating chamber, which is heated by circulating air, surrounds the tubes and the closure devices.

14. A method for preparing sodium, potassium, or lithium from a liquid alkali metal amalgam using an electrolysis apparatus according to claim 1.

* * * * *